US006414281B1

(12) United States Patent
Long et al.

(10) Patent No.: US 6,414,281 B1
(45) Date of Patent: Jul. 2, 2002

(54) HOT-TOE MULTICELL ELECTRIC HEATER

(75) Inventors: Dennis P. Long, Monroe City; Daniel A. Davis, Durham, both of MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 0 days.

(21) Appl. No.: 09/364,828

(22) Filed: Jul. 30, 1999

(51) Int. Cl.[7] ..... H05B 3/02

(52) U.S. Cl. ..... 219/478; 219/544; 219/476; 219/539; 392/500; 338/239; 338/241

(58) Field of Search ..... 219/544, 476–478, 219/534, 546, 539, 523; 392/500; 338/207, 238, 239, 240, 241, 243, 260, 261, 326

(56) References Cited

U.S. PATENT DOCUMENTS

| | | | | |
|---|---|---|---|---|
| 1,127,373 | A | | 2/1915 | Read |
| 1,359,400 | A | | 11/1920 | Lightfoot |
| 1,667,857 | A | | 5/1928 | Harpster et al. |
| 2,157,884 | A | | 5/1939 | Backer |
| 2,331,093 | A | | 10/1943 | Holand |
| 2,455,102 | A | | 11/1948 | Temple |
| 2,469,801 | A | | 5/1949 | Vogel et al. |
| 2,701,410 | A | | 2/1955 | Huck et al. |
| 3,340,382 | A | | 9/1967 | Lennox |
| 3,346,723 | A | | 10/1967 | Mohn et al. |
| 3,402,465 | A | | 9/1968 | Desloge et al. |
| 3,476,916 | A | | 11/1969 | La Van |
| 3,512,114 | A | | 5/1970 | Dzaack |
| 3,611,559 | A | | 10/1971 | McKay et al. |
| 4,125,761 | A | | 11/1978 | Churchill |
| RE29,949 | E | | 4/1979 | Churchill |
| RE30,126 | E | | 10/1979 | Churchill |
| 4,349,727 | A | | 9/1982 | Churchill |
| 4,965,436 | A | | 10/1990 | Churchill |
| 5,034,595 | A | | 7/1991 | Grendys |
| 5,083,012 | A | * | 1/1992 | Edwards ..... 219/553 |
| 5,575,941 | A | | 11/1996 | Johnson |
| 6,111,234 | A | * | 8/2000 | Batliwalla et al. ..... 219/549 |

* cited by examiner

*Primary Examiner*—Teresa Walberg
*Assistant Examiner*—Shawntina Fuqua
(74) *Attorney, Agent, or Firm*—Blumenfeld, Kaplan & Sandweiss, P.C.

(57) ABSTRACT

A multicell heater is shown with typically round outer tubing, containing a plurality of resistive heating elements having a common inner sheath. The inner sheath has a preferably non-circular cross-section and is given a hairpin bend to form a "U" shape. The resulting configuration, which is much less expensive than conventional multicell heaters, provides efficient heating at the toe end—a usually unheated ("cold") zone in conventional multicell heaters.

26 Claims, 1 Drawing Sheet

HOT-TOE MULTICELL ELECTRIC HEATER

FIELD OF THE INVENTION

The present invention relates to electrical heaters with resistive wire heating elements, and more particularly to an electric heater with multiple resistive wire heating elements in an inner sheath, said inner sheath being packed into an outer tubing.

BACKGROUND OF THE INVENTION

It has been known for some thirty years or more in the heater industry to make heaters having a single outer tubing in which is placed multiple sheathed heaters, each sheathed heater having a resistive coiled wire as a heating element. The resulting heater is known in the industry as a "multicell" because it has multiple heaters wrapped in a single tubing. In general the concept of multicell heaters are describe in U.S. Pat. No. 3,340,382 to Lennox, which is incorporated herein be reference.

The outer tubing (sometimes referred to as an "oversheath") provides extra protection from the elements by further isolating the heating elements from possible contaminants. The outer tubing and can also provide the ability to place the heating power of several heaters within a body having a regular (cylindrical) contour, thus allowing it to be used like a cartridge heater, for example in heating large platens for use in molding aircraft parts. Having multiple heating elements within the same outer sheath allows for heating elements made of larger gauge wire without a reduction in total heat flux (sometimes referred to as "watt density"). This thicker wire typically has a longer life than heating elements made of a narrow gauge wire.

Another example of a heater with outer tubing can be found in U.S. Pat. No. 5,575,941 to Johnson, which is incorporated herein by reference. Johnson attempts to use outer tubing with a single sheathed heating element folded over several times within the outer tubing. The result is a cylindrical heater (like a cartridge heater) with a similar effect to having four heating elements within. Because the single heating element is folded over, it appears at any given perpendicular cross-section of the heater (except at the ends) that it has four heating elements.

"Like prior art, multicell heaters, Johnson has several limitations. The most important of which is that, like prior art multicell heaters, the toe (end) of the heater is left colder than the rest of the outer tubing. At the end of the outer tubing, the inner heater in Johnson only makes contact at a single point (arguably two single points, however in close proximity to one another). Furthermore, the construction of the heater in Johnson does not leave any additional space within the outer tubing for additional components, such as a thermocouple or other type of sensor."

It is thus an object of the present invention to provide a multicell heater with only a single inner sheath within the outer tubing.

It is also an object of the present invention to provide a multicell heater with a toe end that heats to approximately the same temperature as the sides of the outer tubing.

It is yet a further object of the present invention to provide this multicell heater with a thermal well wherein optional sensors may be easily placed.

SUMMARY OF THE INVENTION

In keeping with the above, the present invention comprises outer tubing, wherein a plurality of resistive heating elements having a common sheath are placed. In the preferred embodiment, the resistive heating elements are parallel and coplanar within the inner before insertion into the outer tubing. The inner sheath is then bent into a "U" shape with the bend being made perpendicular to the direction of the heating elements. Thus, once inserted into the outer tubing, the inner sheath has a complete line of contact with the end disk of the outer tubing, rather than a single point of contact. The outer tubing will usually be round (cylindrical) to accommodate most practical applications, however the invention could work just as easily with outer tubing having other cross-sections should the need arise.

To produce this configuration, the inner sheath preferably begins with a non-circular cross-section. A typical cross-section for the inner sheath has flattened sides with semi-circular ends as will be made apparent below.

The bend in the inner sheath provides a gap within the outer tubing which may be filled with reinforcing bars, hollow tubes, or a combination thereof. The hollow tubes may be used as thermal wells, in which sensors such as thermocouples may be positioned.

A typical application for the multicell heaters of the present invention would be to provide a plurality thereof to be inserted together into a superplastic forming platen. Another application would be to place a plurality of the heaters in a duct to heat air or other gasses by forced convection. The number of different applications for the present heater is infinite. It can be used in any manner conventional multicell heaters are used, but are less expensive to manufacture and provides more efficient heating at the toe end.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted however, that the appended drawings illustrate only several typical embodiments of this invention and is therefore not to be considered limiting of its scope, for the invention may admit to other equally effective embodiments. Reference the appended drawings, wherein.

DETAILED DESCRIPTION OF THE INVENTION

Figure 1:
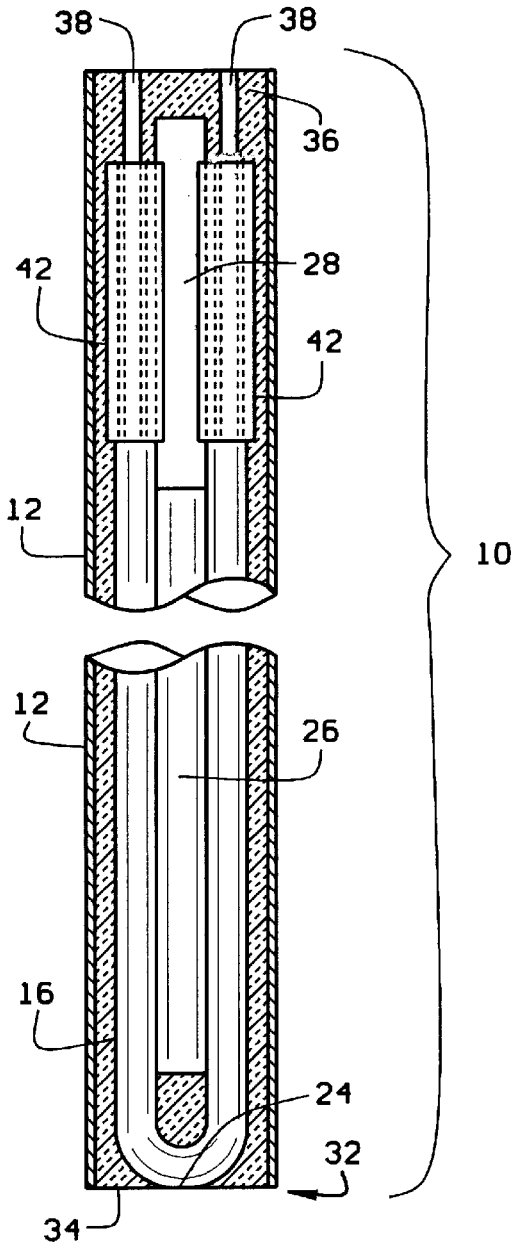
FIG. 1 is cross-sectional side view of a multicell heater embodying the present invention.

Referring now to FIG. 1 a multicell heater 10 embodying the present invention is shown generally. The main housing for the heater 10 is a section of outer tubing 12. Although the composition of the outer tubing 12 is not important, the outer tubing 12 is known to be metallic, preferably being made of Inconel®, Incoloy®, or steel, depending upon the intended application. Within the outer tubing 12 is disposed a plurality of resistive heating elements 14 having a common inner sheath 16. The inner sheath 16 is also known to be metallic. The inner sheath 16 and heating elements 14 without the outer tubing resemble the construction of a tubular heater known sold under the trademark Firebar® by the assignee hereof, Watlow Electric Manufacturing Company of St. Louis, Mo.

Figure 2:
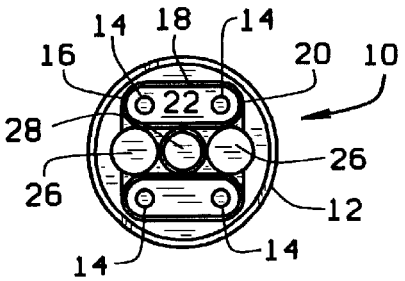
FIG. 2 is an end view of the heater of FIG. 1.
Figure 3:
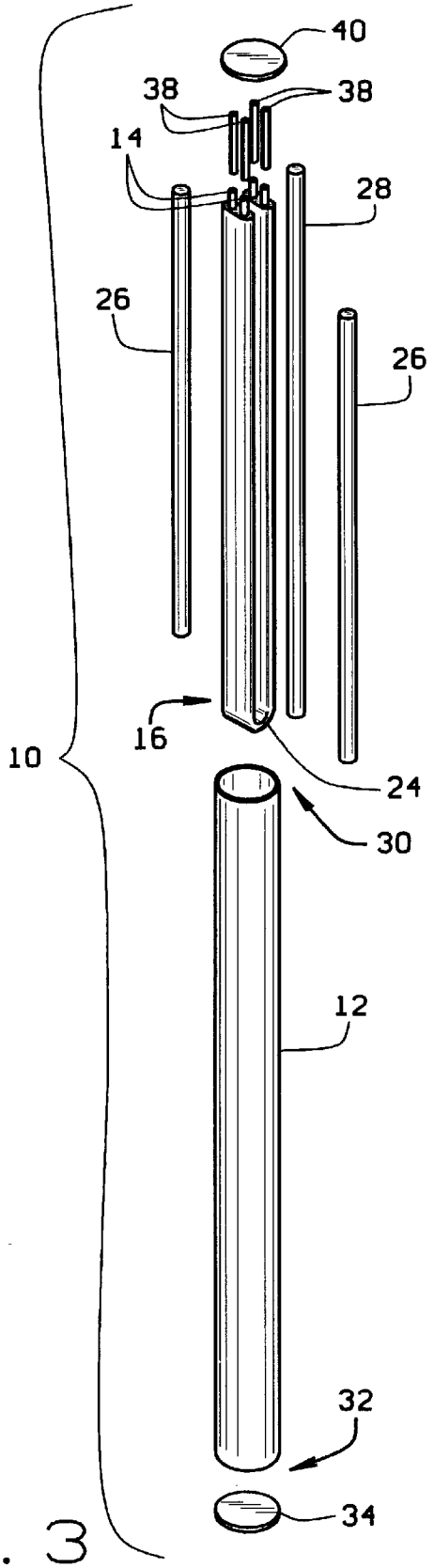
FIG. 3 is an exploded view of the heater of FIG. 1.

In the preferred embodiment, the inner sheath 16 has a non-circular cross-section. As best seen from FIG. 2, where both ends of the bent inner sheath 16 can be seen, the cross-section has two opposite flattened sides 18 connected by semi-circular edges 20. The inner sheath is typically filled with an insulator 22, most commonly consisting of magnesium oxide (MgO).

The heater may have several heating elements 14, although the simplest case of two heating elements 14 is shown in the drawings. The heating elements are preferably, but not necessarily, parallel and coplanar. The resistive heating elements 14 can be made of any conventional material for such, but will most commonly consist of nickel chromium (NiCr) wire or NiCr wire with an outer treating.

The heating elements 14 and inner sheath 16 are bent to form a hairpin bend 24. The resulting "U" shaped structure is then placed in the outer tubing 12. The bend is preferably perpendicular to the heating elements 14 to provide symmetry of the inner structure (heating elements 14 and inner sheath 16). The space formed between the legs of the "U" can optionally be filled with a variety of components. The preferred embodiment, shown in the drawings, has a pair of reinforcing bars 26 and a thermal well 28. The reinforcing bars 26 are typically solid metal rods that not only provide structure support within the outer tubing 12, but also provide excellent heat transfer around the multicell heater 10. The thermal well 28 is a hollow metal tube, in which a variety of sensor types (a thermocouple for example) may be placed. The thermal well 28 makes the sensor easily replaceable in comparison to heaters that have a temperature sensor integrated into the inner sheath. Any remaining dead space within the outer tubing 12 is filled with another insulating fill 36, such as MgO powder.

The outer tubing has a lead end 30 and a toe end 32. In a conventional prior art multicell heater the heating elements do not come close to the toe end, and therefore leave an unheated "cold" zone which remains at a significantly lower temperature than the remaining outer tubing. The present invention provides contact between the inner sheath and the end disk (or cap) 34. Although in a prior art multicell heater the toe end typically gets too hot to touch, energizing the heater one can plainly see that the majority of the outer tubing becomes a glowing red, while a section near the toe end remains dark. During the same demonstration on a typical embodiment of the present invention, one can plainly see that the entire heater, including the toe end 32 and end disk 34 are glowing red. Operating temperatures for a typical application may range from 1300° to 1900° F.

After the heating elements 14 are placed in the outer tubing 12 with the sheath 16 and other components, power leads 38 are attached to the end of each of the heating elements 14. The leads 38 may be made of a conventional lead material such as nickel and attached to the heating elements 14 by conventional means such as welding. In the preferred embodiment, ceramic insulators 42 are placed over connections between the leads 38 and the heating elements 14. Additionally, an end disk 40 is placed over the lead end 30 of the outer tubing to keep out contaminants and keep in the insulating fill 36.

Therefore it should be evident that the present invention possesses at least two, major advantages over prior art multicell heaters. The use of single inner sheath substantially decreases cost of manufacture, sometimes by as much as 56% depending on the number of heating elements (cells) used. The other result of using a single sheath in the manner described is that the cold zone usually found in conventional multicell heaters is eliminated.

While the foregoing is directed to the preferred embodiments of the present invention, other and further embodiments of the invention may be devised without departing from the basic scope thereof, and the scope thereof is determined by the claims which follow.

We claim:

1. An electric heater comprising:

outer tubing;

a single inner sheath disposed within said outer tubing;

a plurality of resistive heating elements disposed within said single inner sheath; and at least two leads affixed to the end of each said resistive heating element and adapted to receive power for energizing said respective resistive heating element.

2. The electric heater of claim 1, further comprising an insulating fill between said outer tubing and said inner sheath and between said inner sheath and said resistive heating elements.

3. The electric heater of claim 2, wherein said insulating fill is magnesium oxide.

4. The electric heater of claim 1, wherein said inner sheath has a non-circular cross-section.

5. The electric heater of claim 4, wherein the cross-section of said inner sheath has two flat sides connected by two substantially semi-circular edges.

6. The electric heater of claim 5, further comprising an end disk covering one end of said outer tubing.

7. The electric heater of claim 6, wherein said inner sheath and resistive heating elements are placed so as to heat said end disk to at least approximately the same temperature as said outer tubing.

8. The electric heater of claim 6, wherein said inner sheath has more than a single point of contact with said end disk.

9. The electric heater of claim 8, wherein said inner sheath has a U-shaped bend thereby forming two legs, and further comprising a well nested between said legs.

10. The electric heater of claim 9, further comprising one or more steel reinforcing rods disposed within said outer tubing and adjacent to said inner sheath.

11. The electric heater of claim 9, further comprising a sensor located within said well.

12. An electric heater comprising:

outer tubing;

an inner sheath disposed within said outer tubing, said inner sheath having a non-circular cross-section;

a plurality of resistive heating elements disposed within said inner sheath; and at least two leads affixed to the end of each said resistive heating element and adapted to receive power for energizing said respective resistive heating element.

13. The electric heater of claim 12, further comprising an insulating fill between said outer tubing and said inner sheath and between said inner sheath and said resistive heating elements.

14. The electric heater of claim 13, wherein said insulating fill is magnesium oxide.

15. The electric heater of claim 14, wherein the cross-section of said inner sheath has two flat sides connected by two substantially semi-circular edges.

16. The electric heater of claim 15, further comprising an end disk covering one end of said outer tubing.

17. The electric heater of claim 16, wherein said inner sheath and resistive heating elements are placed so as to heat said end disk to at least approximately the same temperature as said outer tubing.

18. The electric heater of claim 16, wherein said inner sheath has more than a single point of contact with said end disk.

19. The electric heater of claim 18, wherein said inner sheath has a U-shaped bend thereby forming two legs, and further comprising a well nested between said legs.

20. The electric heater of claim 19, further comprising one or more steel reinforcing rods disposed within said outer tubing and adjacent to said inner sheath.

21. The electric heater of claim 19, further comprising a sensor located within said well.

22. An electric heater comprising:

outer tubing;

an end disk covering one end of said outer tubing;

an inner sheath disposed within said outer tubing and contacting said end disk;

a plurality of resistive heating elements disposed within said inner sheath;

at least two leads affixed to the end of each said resistive heating element and adapted to receive power for energizing said respective resistive heating element; and wherein said inner sheath and said resistive heating elements are placed so as to heat at least portions of said end disk to at least the same temperature as the average temperature of said outer tubing.

23. The electric heater of claim 22, wherein said inner sheath has more than a single point of contact with said end disk.

24. An electric heater comprising:

outer tubing;

an inner sheath disposed within said outer tubing, said inner sheath having a U-shaped bend thereby forming two legs;

a plurality of resistive heating elements disposed within said inner sheath;

at least two leads affixed to the end of each said resistive heating element and adapted to receive power for energizing said respective resistive heating element; and a well nested between said legs of said inner sheath.

25. The electric heater of claim 24, further comprising one or more steel reinforcing rods disposed within said outer tubing and adjacent to said inner sheath.

26. The electric heater of claim 24, further comprising a sensor located within said well.

* * * * *